United States Patent [19]

Ramey et al.

[11] Patent Number: 4,535,925

[45] Date of Patent: Aug. 20, 1985

[54] SEMI-AUTOMATIC PNEUMATIC EXPANSION RIVET GUN

[75] Inventors: Carl Ramey, Yellville; Royce W. Hill, Flippin; James H. Beijen, Mountain Home, all of Ark.

[73] Assignee: Micro Plastics, Inc., Flippin, Ark.

[21] Appl. No.: 521,931

[22] Filed: Aug. 10, 1983

[51] Int. Cl.[3] ..... B21J 15/02

[52] U.S. Cl. ..... 227/55; 72/391; 29/511; 227/120; 227/130; 227/156

[58] Field of Search ..... 29/450, 453, 511, 512, 29/517, 520, 523; 24/67 R, 453, 741; 72/391; 227/10, 95, 51, 120, 156, 52, 53, 54, 55, 130; 411/17, 34, 41, 38, 44, 28, 42, 70, 68, 75, 181

[56] References Cited

U.S. PATENT DOCUMENTS

| | | | |
|---|---|---|---|
| 3,638,532 | 2/1972 | Novak | 227/130 X |
| 3,758,241 | 9/1973 | Eheim | 123/503 X |
| 4,089,099 | 5/1978 | Nivet | 227/120 X |
| 4,131,009 | 12/1978 | Hara et al. | 227/55 X |
| 4,183,239 | 1/1980 | Stubbings | 227/130 X |
| 4,222,304 | 9/1980 | Yoshida et al. | 411/181 |
| 4,259,858 | 4/1981 | Freeman et al. | 227/130 X |
| 4,364,506 | 12/1982 | Schneider | 227/10 |
| 4,448,338 | 5/1984 | Graf et al. | 227/130 X |

*Primary Examiner*—Paul A. Bell
*Attorney, Agent, or Firm*—Stephen D. Carver

[57] ABSTRACT

A semi-automatic hand-held pneumatic gun for installing plastic rivets. The gun includes a handle equipped with a manual trigger, and an associated magazine which serially feeds a plurality of stored rivets. Repetitive semi-automatic cycling of the gun is established by cooperation between a triggered air system, an intermediate pneumatic system, and a pneumatic barrel assembly. The trigger valve establishes a plurality of pneumatic pathways between it a manifold and the intermediate pneumatic system, activating first and second intermediate valves disposed within the intermediate valve pneumatic chamber. The barrel chamber includes an elongated ram and an associated piston. When the trigger valve is in a rest position, a pneumatic path is established whereby the first intermediate valve is biased to a rest position establishing another pneumatic path biasing the piston to a rest position. When the trigger valve is pulled, it establishes another pneumatic path, coupled to the intermediate pneumatic chamber which displaces the second intermediate valve to direct high pressure air to the rear of the barrel chamber, thereby forcing the piston forwardly to contact a plunger within the ram to install a rivet. The trigger valve establishes additional pneumatic paths when released, returning the second intermediate valve to the rest position. However, at this time the first intermediate valve returns the piston to rest, and urges the ram rearwardly. When moving rearwardly within the barrel chamber the ram establishes an air path which returns the first intermediate valve to rest.

11 Claims, 23 Drawing Figures

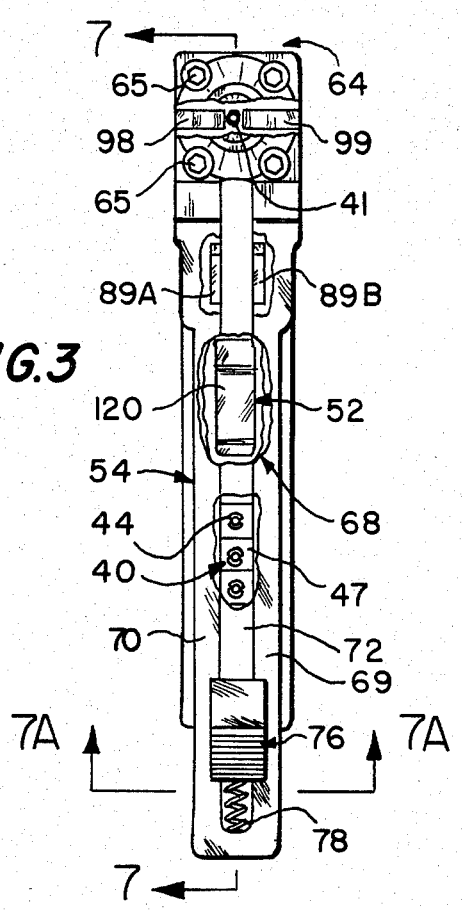
FIG.3
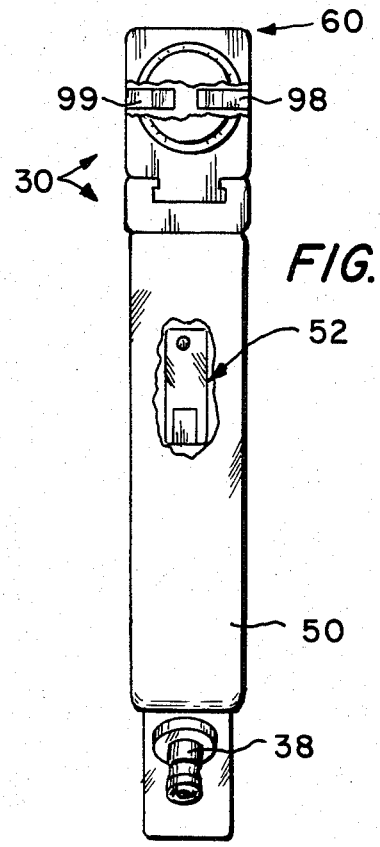
FIG.4
FIG.5
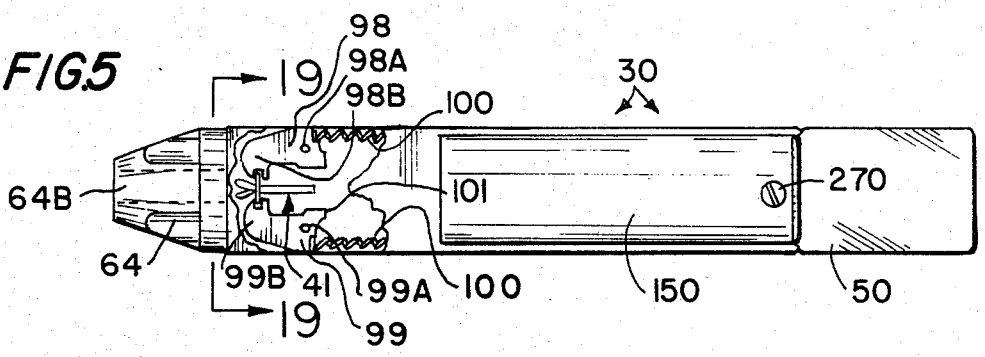
FIG.6
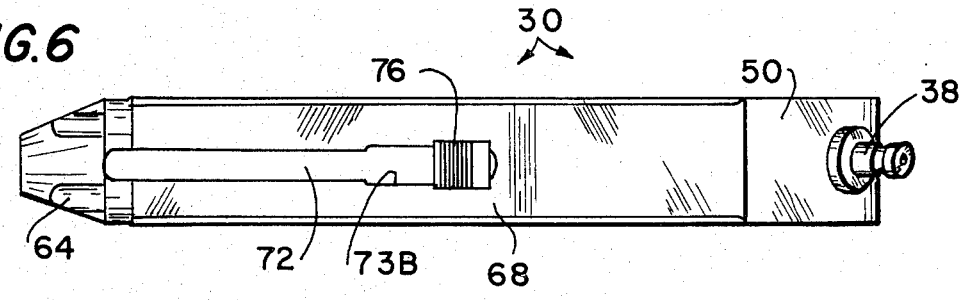

18
16A
19
17
50
52
127
130B
130
129B
129
128
132
134
168
169
160
124
166
164
178
162
202
205
204
206
207
208
216
170
211
212
210
175
219B
217
173A
173B
279E
277
224
226A
143
222
221
200
140
142
144
145
144E
202E
202J
220
188
184
172
180

FIG. 17
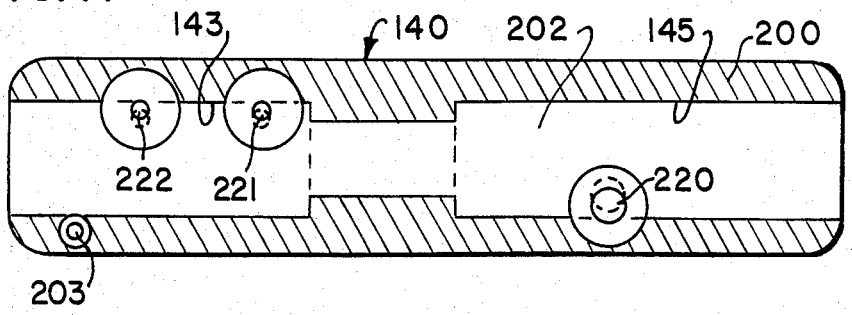
FIG. 18
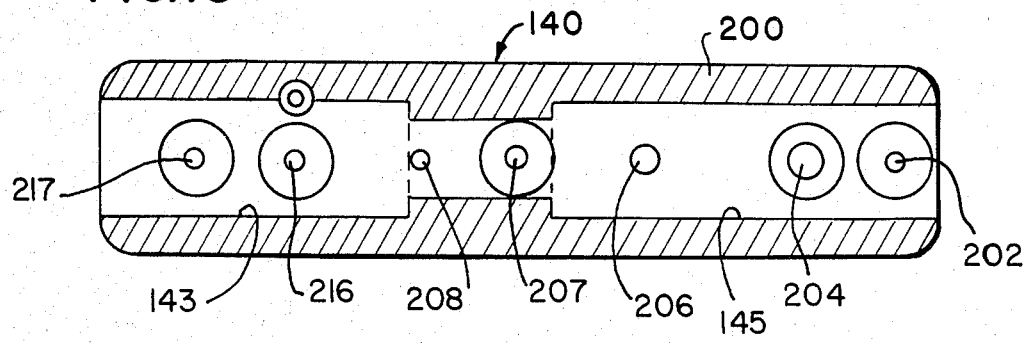
FIG. 21
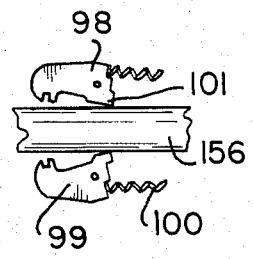
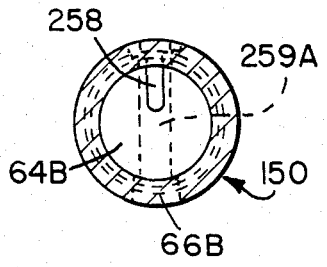
FIG. 20
FIG. 19
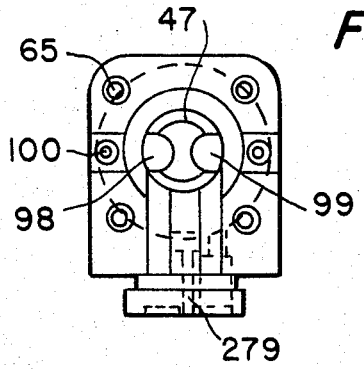

SEMI-AUTOMATIC PNEUMATIC EXPANSION RIVET GUN

BACKGROUND OF THE INVENTION

The present invention relates generally to guns adapted to install conventional plastic rivets, such as expansion rivets and the like. More particularly, the present invention is directed to a hand held, semi-automatic air powered gun which serially ejects and installs expansion rivets.

Plastic expansion rivets are well known in the fastening arts. Preferably such rivets are molded through conventional plastic injection molding techniques in a one-piece unit. Typically, modern expansion rivets include an intermediate flange portion separating an integral, generally cylindrical stem from an adjacent cooperating tubular expansible segment. The latter segment is relieved radially, resulting in separate elongated sections which enable the segment to expand. Expansion or "blind" rivets fasten work pieces together when the expansible rivet portion is first inserted through the adjacent work piece orifice, and thereafter "expanded" by forcible axial insertion of the stem by force sufficient to break it away from and subsequently penetrate the flange. Expansion prevents subsequent withdrawal of the fitting, since the expanded shank compressably, frictionally occupies the void formally presented by the aligned work piece orifices. It is well known to apply such rivets with the use of hand-held tools such as mallets or the like.

Known prior art expansion rivets, which may be otherwise known as "blind" rivets, fasteners or the like, are seen in the following U.S. Pat. Nos.: 4,222,304; 2,030,169; 2,408,559; 2,803,984; 3,178,989; 3,230,818; 3,251,260; 3,294,303; 3,521,521; 3,702,088 and 3,758,241.

In the aircraft industry, for example, aligned body or structural members of aircraft often must be temporarily fastened together during certain assembly phases. In the prior art it is known to employ a "Clico" or "Wedgelock" metallic tool which includes an expansible metallic sleeve. The sleeve includes a number of fork-like tines which are expanded when a flat tongue is projected axially therewithin. While such a tool will yieldably maintain two or more apertured aligned work pieces together, the costs involved in employing a vast army of these tools is a major detriment. Rather than employ such a tool, metallic rivets can and have been used for temporary assembly purposes. However, they must be subsequently removed prior to completion of final assembly. During the critical removal stages, damage to high tolerance, metallic sheet metal parts may occur in response to drilling. Metal shavings and the like present an obstinate clean-up problem. Thus the employment of plastic expansion rivets for purposes such as this is desirable, as previously suggested in U.S. Pat. No. 4,493,205, owned by the same Assignee as this case.

It has thus been found desirable to provide some form of pneumatic rivet applicator tool for quickly and easily inserting plastic expansion rivets during the assembly of metallic elements, such as those employed in the aircraft industry.

However, as for example during the construction of aircraft wing sections, a great number of plastic expansion fittings must be sequentially installed. Such work is repetitive and time consuming, and even the benefits of a manual gun may not sufficiently reduce assembly time requirements where literally thousands and thousands of rivets must be installed. Hence we have designed a semi-automatic gun which serially outputs and installs expansion rivets without the need for constant manual single shot reloading. The closest prior art known to applicant is U.S. Pat. No. 4,364,506 which discloses a gun-like fastener installation tool.

SUMMARY OF THE INVENTION

The present invention comprises a hand-held, pneumatic semi-automatic rivet gun. The gun is ideally adapted for storing and serially installing plastic expansion rivets used during the manufacture, alignment or installation of workpieces having suitable apertures.

Preferably the gun includes a rigid piston grip adapted to be hand held by a workman for operating the gun. Integral with the gun is a magazine spaced-apart from the grip. This magazine includes a plurality of expansion rivets, which rivets are serially biased towards a feed point by a spring follower within the magazine. An elongated, generally tubular barrel extends on the top of the gun between the grip and the magazine, and it is adapted to serially receive rivets from the magazine means in periodic, semi-automatic fashion. The tip of the barrel includes an applicator nozzle, which is relieved through a lower central slot for receiving rivets interiorly within a suitable machined section. As rivets are discharged from the magazine into the barrel nozzle, they are temporarily secured by a pair of gripper arms which are pivotally operable within the barrel and which temporarily grasp the rivet flanges.

Three pneumatic sub-systems are preferably employed in conjunction with the present gun. A trigger actuated pneumatic control system is defined within the pistol grip. A hand operated trigger, which is normally biased to a "rest" position, controls a trigger spool valve axially disposed within a suitable trigger valve chamber defined within a trigger housing. The trigger valve, which is spring biased to a "rest" position, is configured to produce a variety of pneumatic flow paths depending on its relation to a plurality of input and output orifices defined through the trigger valve chamber. A source of external air is coupled to the trigger chamber, supplied in fluid flow communication with a conventional pneumatic fitting at the bottom of the pistol grip which is adapted to be attached to conventional HP air available from job site air lines.

An intermediate pneumatic switch system is controlled by the trigger system and functionally governs the internal action of the gun. Preferably this intermediate pneumatic switch system includes an intermediate pneumatic chamber of generally tubular, elongated characteristics located above the trigger assembly within the pistol grip. The intermediate chamber houses first and second axially aligned intermediate spool valves which are configured to produce a variety of pneumatic signals in response to movement relative to a multiplicity of ports defined in the intermediate pneumatic chamber. A pneumatic manifold couples the trigger spool valve system to the intermediate system. Thus in response to varying pneumatic paths between the trigger assembly and the intermediate pneumatic chamber a plurality of pneumatic control signals are developed.

The first and second intermediate valves establish a plurality of pneumatic air paths for controlling a rivet applicator ram and an associated piston within the pneumatic barrel chamber. The barrel chamber is also of elongated, tubular design, and it includes a plurality of input and output orifices for establishing operative air paths.

One pneumatic path through the trigger valve chamber to the intermediate chamber is established by the trigger valve when in a "rest" or "fire" position which biases the first intermediate spool valves to a rest position. When in such a rest position, the first intermediate valve directs air through a preselected output port in the intermediate chamber to appropriate barrel inlet ports, establishing another pneumatic path to effectuate biasing of the piston to a "rest" position. When fully displaced (i.e. "fired") by the trigger, the trigger valve establishes another pneumatic path transferring air to an inlet port associated with the intermediate chamber which displaces the intermediate valves to expose yet another pneumatic path in fluid flow communication with the rear of the barrel chamber. Establishment of the pneumatic path thus forces the piston forwardly with respect to the ram means to in effect "fire" the gun. A plunger within the ram is thus forced by the piston into ramming engagement with the shank of an ejection rivet, formerly held by the ram front, and the rivet is forcibly ejected from the gun.

When the trigger is released, the spring biased trigger valve returns to the rest position, re-establishing a pneumatic path resulting in the return of the second intermediate valve to a rest position. The second intermediate spool valve creates an air path which returns the ram and piston rearwardly. The piston is now at rest and the ram is in a rest position. As the ram moves rearwardly, a groove defined in it passes between a pair of stationary O-rings disposed about a return air path. Air is thus vented downwardly to return the first intermediate spool valve to a rest position and when in a rest position, the first intermediate valve returns the ram forwardly, thus re-cocking it. In other words, the ram is forced forwardly and grasps a rivet from the gripper arms, deflecting same apart, and assuming a "fire" position. When the trigger is pulled the cycle of semi-automatic rivet feeding, loading, application and expansion may be repeated.

Thus a broad object of the present invention is to provide a semi-automatic pneumatic gun for installing plastic rivets.

A more particular object of the present invention is to provide a semi-automatic applicator gun for reliably and repetitively installing plastic expansion rivets.

Yet another object of the present invention is to reduce labor costs associated with the installation of plastic expansion rivets.

Another object of the present invention is to greatly reduce the time normally required for the assembly of multi-apertured aligned work pieces such as aircraft body parts and the like.

A still further object of the present invention is to provide a system for reliably and quickly installing plastic expansion rivets in replacement of metallic tools, metallic rivets, or other prior art approaches.

Yet another object of the present invention is to avoid the use of hammers, mallets or the like during the installation of expansion rivets.

Another object of the present invention is to provide a semi-automatic rivet gun of the character described which will repetitively install rivets stored in great quantity in an associated magazine.

Another fundamental object is to provide a semi-automatic rivet gun with a dependable and forcible action, simultaneously with the inclusion of an easily manipulated trigger assembly. An important feature of the invention is that high volume air blasts required for effective barrel action are controlled by an intermediate pneumatic switch system which is in turn controlled by a pneumatic trigger assembly.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 3 is a front plan view of the rivet gun, with portions thereof broken away, omitted, or shown in section for clarity;

FIG. 4 is a rear plan view of the rivet gun, with portions thereof broken away, omitted, or shown in section for clarity;

FIG. 5 is a top plan view of the rivet gun with portions thereof broken away, omitted, or shown in section for clarity;

FIG. 6 is a bottom plan view of the rivet gun;

FIG. 17 is a reduced scale, top plan view of the intermediate valve housing taken along line 17—17 of FIG. 16 generally in the direction of the arrows;

FIG. 18 is a reduced scale, bottom plan view of the intermediate valve housing, taken generally along line 18—18 of FIG. 16 in the direction of the arrows;

FIG. 19 is an enlarged sectional view taken generally along line 19—19 of FIG. 5;

FIG. 20 is a sectional view taken generally along line 20—20 of FIG. 13; and,

FIG. 21 is an enlarged, fragmentary sectional view illustrating the gripper arms in a rivet release position.

DETAILED DESCRIPTION OF THE DRAWINGS

Figure 1:
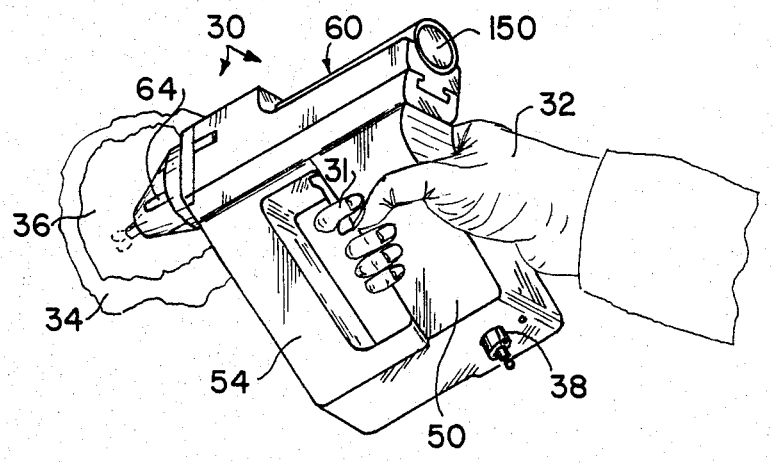
FIG. 1 is a fragmentary, pictorial view illustrating a preferred mode of a semi-automatic rivet applicator gun constructed in accordance with the teachings of the present invention.

With initial reference now to FIGS. 1-6 of the appended drawings, a semi-automatic, pneumatic expansion rivet gun constructed in accordance with the preferred mode of the present invention has been generally designated by the reference numeral 30. Gun 30 is adapted to be grasped by the hand 32 of an ooperator for inserting plastic expansion drive rivets through suitable aligned orifices defined within adjacent workpieces 34, 36. As best viewed in FIGS. 7-11, a typical expansion rivet 40 is of integral construction, comprising an elongated stem 42 and a plurality of forwardly projecting leg members 44 extending outwardly from a generally cylindrical base 46. Base 46 is separated from stem 42 by a flange 47, and when stem 42 is forcibly rammed through base 46 and flange 47 the leg members 44 will be expanded to prevent subsequent withdrawal of the rivet. The rivets may thus be expandably fastened within and/or through one or more aligned workpieces.

Gun 30 comprises a hand grip section 50 equipped with an actuating trigger 52 for manipulation by finger 31 (FIG. 1) of the operator. Grip 50 is of generally rectangular dimensions. Spaced apart from grip 50 is a magazine 54 which serially stores, receives and/or feeds a plurality of expansion rivets 40 to be installed. A barrel assembly, generally designated by the reference numeral 60, extends on top of gun 30 between grip 50 and magazine 54. Barrel assembly 60 is ultimately operated, as will hereinafter be described in detail, by high pressure air entering gun 30 through a conventional fitting 38 at the base of handle 50. The output end of the assembly 60 terminates in a separate feed head 64 secured by screws 65 (FIGS. 2, 19). A plurality of air paths are included within gun 30 whereby repeated manual operation of trigger 52 automatically results in the serial output and installation of expansion rivets. Preferable each of the flange portions 47 of the rivets are joined together during the molding process in the form of a yieldable or deformable strip (FIG. 3). This aids in the loading and feeding of the rivets, and the tear strips between adjacent rivet flanges are broken away during forceable pneumatic installation and ejection of rivets from the gun. Alternatively single rivets can be loaded into magazine 54.

Figure 7A:
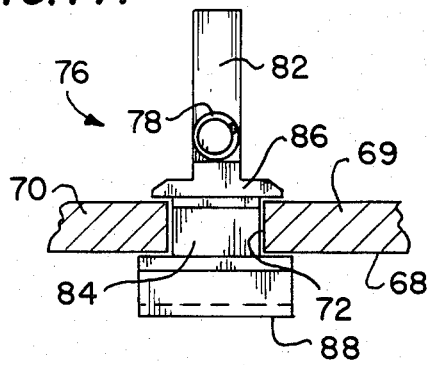
FIG. 7A is an enlarged, fragmentary sectional view taken generally along line 7A—7A of FIG. 3, and with the rivet loader depicted in the "load" position.

As best viewed in FIGS. 2-3, and 7A, magazine 54 includes a front surface 68 divided into a pair of opposite walls 69 and 70 which are separated by an elongated feed slot 72. Rivets are captured within the feed slot, the flanges 47 thereof abutting up against wall segments 69, 70, and the base 46 projecting through slot 72 between the wall segments. Leg members 44 project outwardly from the wall segments 70, 72.

A rivet loader, generally designated by the reference numeral 76, is captured within slot 72 between walls 69 and 70 (FIGS. 7, 7A), and biases the rivets 40 upwardly in response to yieldable pressure from a captured spring 78. Spring 78 is disposed within a suitable passageway 79 extending into upper contact with the rear horn 82 of loader 76. As best viewed in FIG. 7A, the rivet loader 76 includes an intermediate diameter portion 84 separated between a flange 86 and the manually maneuverable forward edge 88, being slidably captured within guide slot 72. Each of the rivets 40 is thus biased upwardly into an applicator feed position occupied by rivet 41, (FIG. 7) which is the next rivet to be outputted by the apparatus. However, before entering the position of rivet 41, each rivet is maneuvered through an intermediate feed position occupied by rivet 41B. As best viewed in FIGS. 2 and 3, a pair of rivet loader retainers, generally designated by the refernece numerals 89A, 89B are preferably employed to guide the rivets to the application position. As best viewed in FIG. 2, these rivet loader retainers include a slanted portion 92 which contacts the flanges 47 of each rivet to gently tilt the rivet into the position occupied by rivet 41B (FIG. 7) during the feed process. Rivet retainers 89A, 89B are thus disposed on opposite sides of slot 72, being secured with conventional screws 95 (FIG. 2). As will be hereinafter described in detail, when rivets are serially fed and outputted, rivets may be temporarily retained within a pair of pivots, spaced apart gripper arms 98, 99 which are pivoted at mounts 98A, 99A respectively (FIGS. 5, 21). The forward gripper slotted ends 98B and 99B project inwardly and yieldably grasp the rivet flange 47 to temporarily secure the rivet for subsequent ejection. Rivets are restrained by the gripper arms only temporarily during ram recycling, as will hereinafter be described.

Figure 12:
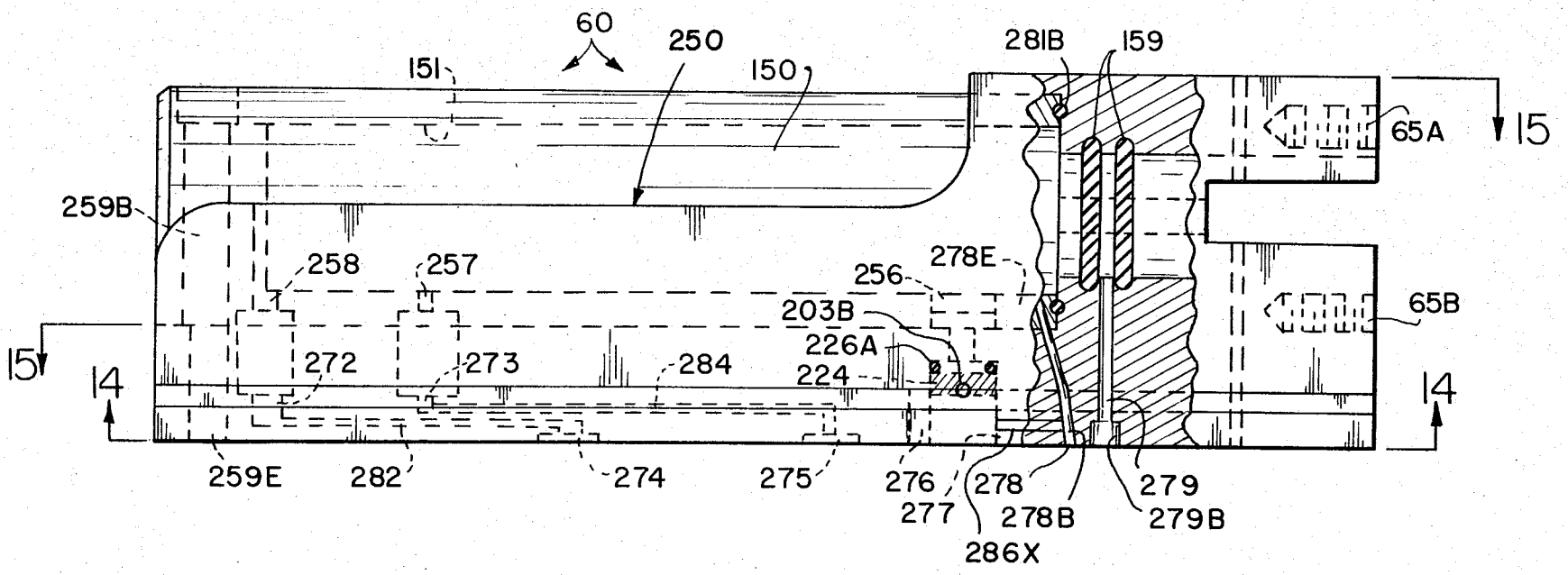
FIG. 12 is an enlarged, fragmentary assembly view showing the cylinder mount and the ram cylinder, with certain critical air paths and structural boundaries indicated in dashed lines.

The applicator head 64 includes an internal passageway 64 through which rivets are outputted. With reference to FIGS. 3, 12 and 19, the rivet applicator feed head 64 is secured to the barrel assembly 60 with a plurality of conventional mounting bolts 65.

Figure 7:
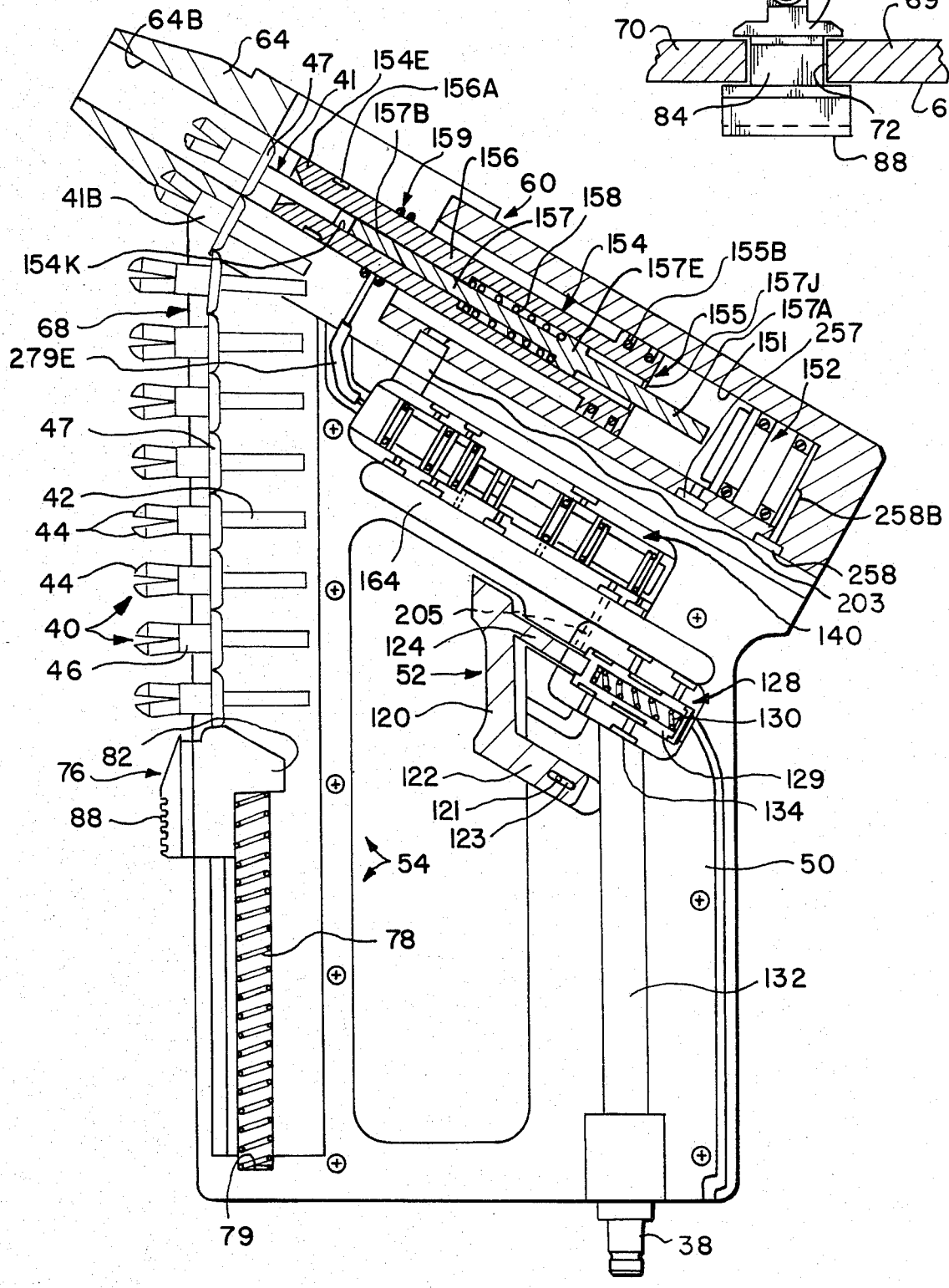
FIG. 7 is an enlarged, fragmentary sectional view taken generally along line 7—7 of FIG. 3, with portions thereof omitted for clarity; with the plunger assembly disposed in an intermediate position.

The rivet gripper arms 98, 99 are yieldably, temporarily maintained in a rivet grasping position by springs 100 (FIGS. 5, 21). When activated, the ram to be later described forcibly contacts gripper arm ends 101 (FIG. 5) to pivot grasping ends 98B, 99B away from the flange 47 of the formerly retained rivet, releasing same. Virtually simultaneously the rivet stem is captured in the tubular end of the ram. When the ram moves rearwardly prior to subsequent automatic reloading, the springs 100 immediately thereafter close the gripper arms 98, 99 about the flange of the next rivet which has been serially biased into position by rivet loader 76 and its spring 78 (FIG. 7). The gripper arms temporarily catch the next rivet after the gun has been fired, and the ram moves rearwardly before returning forwardly to then "load" the rivet restrained by the gripper arms.

Figures 16, 16A:
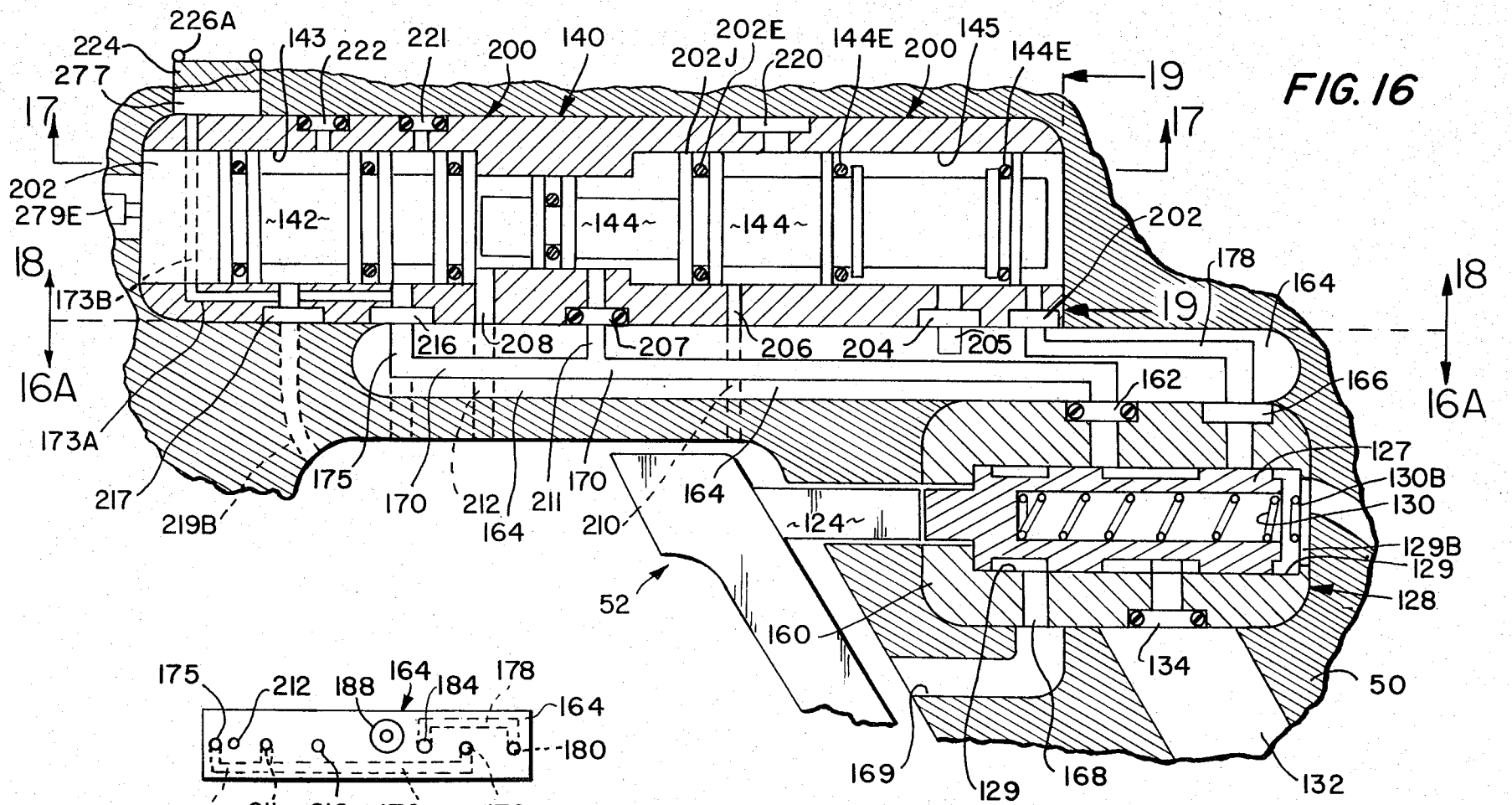
FIG. 16 is an enlarged, fragmentary sectional view illustrating the trigger housing and intermediate air control system, with portions omitted for clarity.
FIG. 16A is a reduced scale top plan view of the manifold taken generally along line 16A—16A of FIG. 16.

As best viewed in FIGS. 2, 4, and 7-10, trigger 52 includes an integral, generally vertical portion 120 which extends between a lower, generally horizontal follower portion 122 and an upper generally horizontal actuator link 124. Trigger 52 is captured within handle 50 by a suitable screw 121 (FIG. 7) which tracks within a follower slot 123 defined in trigger follower portion 122. The trigger link 124 extends rearwardly through handle 50 and communicates interiorly of the trigger pneumatic control section, which has been generally designated by the reference numeral 128. An elongated spring 130 captured within the trigger pneumatic housing 160 (FIG. 16) makes contact with a trigger pneumatic control valve, generally designated by the reference numeral 127, which is longitudinally captured with the trigger chamber 129 for axial displacement therewithin. As best viewed in FIG. 16, trigger 127 is interiorly relieved to receive internal spring 130 which normally biases valve 127 into contact with trigger link 124. It will thus be apparent that spring 130 normally maintains the trigger valve 127 and the trigger 52 in a rest position, contacting and being restrained by end cap 129 B (FIG. 16). As shown in FIG. 7, high pressure air is delivered to the trigger pneumatic section 128 via an elongated passageway 132 which communicates interiorly of chamber 129 through a first inlet port 134 (FIGS. 7, 16).

The pneumatic trigger control section 128 communicates through a plurality of pneumatic passageways defined in manifold 164 (FIG. 16A) via an intermediate air control section generally designated by the reference numeral 140. In response to pneumatic signals inputted to intermediate air control section 140, first and second intermediate spool valve members, respectively designated by the reference numerals 142 and 144 (FIG. 16), are axially displaced within separate chambers 143, 145 respectively. The intermediate air control section 140 operationally communicates with a pneumatic barrel cylinder, generally designated by the reference numeral 150, which is part of barrel assembly 60. Pneumatic barrel cylinder 150 includes internal chamber 151 housing a pneumatic piston, generally designated by the reference numeral 152, and an elongated pneumatic ram, generally designated by the reference numeral 154 (FIGS. 7–10). Through the plurality of air paths generated by the trigger pneumatic control section 128, piston 152 and ram 154 are properly recycled and controlled. As seen in FIG. 12, the pneumatic barrel assembly 60 includes a cylinder mount 250 for barrel cylinder 150, which is mechanically secured by a conventional screw 270 (FIG. 2) which penetrates aligned holes 259B in barrel 150 and 259E in mount 250 (FIG. 12).

Figure 14:
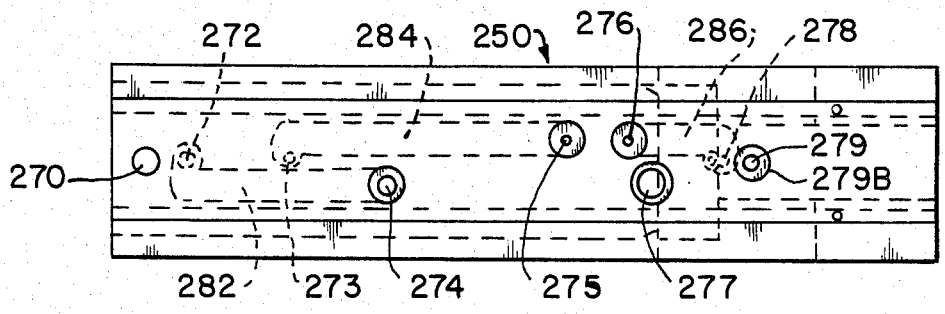
FIG. 14 is a bottom plan view of the ram cylinder mount taken generally along line 14—14 of FIG. 12.

The intermediate air control housing 200 (FIG. 16), preferably of machined plastic construction, includes axially aligned internal chambers 143, 145 housing the first and second axially displaceable intermediate spool valves 142, 144 respectively. A plurality of bottom ports (FIG. 18) are provided for communicating with the manifold 164 (FIG. 16A) located beneath housing 200. Outlet ports (FIG. 17) communicate with the barrel cylinder 250 (FIGS. 12, 14). Independent, concurrent operation of intermediate air valves 142, 144 create a plurality of pathways effectuating pneumatic control and operation of the gun. In other words, concurrent operation of the ram 154 and piston 152 is controlled by timed functioning of the intermediate valves 142, 144.

With primary reference now to FIG. 16, the trigger pneumatic control section, generally indicated by the reference numeral 128, includes a preferably plastic, trigger valve housing 160 secured within handle 50. Trigger spool valve 127 is slidably disposed within the generally cylindrical cavity 129 formed therewithin, against yieldably bias from internal spring 130. As previously mentioned a first port 134 defined in housing 160 admits high pressure air via inlet passageway 132. Movement of the trigger spindle valve 127 thus establishes a plurality of pneumatic pathways which will hereinafter be described in detail. Preferably valve 127 is suitably machined from brass. It will be appreciated that by positioning the spool valve 127 as desired, the reduced diameter portions thereof, which are located between extended diameter portions, will establish air flow between various ports on opposite sides of the trigger valve housing 160. In the rest position illustrated in FIG. 16, high pressure air entering port 134 is thus transmitted to an output port 162 which communicates interiorly of manifold 164. However, at this time an additional outlet vent 166 is blocked by valve element 127, as is exhaust port 168, which is in fluid flow communication with an exhaust channel 169 defined in handle 50. Trigger housing 160 thus pneumatically communicates through a plurality of passageways between the manifold 164 and the intermediate air control section 140.

With reference now to FIGS. 12 through 15, the pneumatic barrel assembly 60 includes a rigid pneumatic cylinder mount 250, and the elongated barrel cylinder 150 which nests on top of the mount 250, and which is forwardly sealed by O-ring 281B. As previously mentioned, piston 152 and ram 154 are slidably, axially disposed within the barrel chamber 151 (FIGS. 7–11). Barrel cylinder 150 and the mount 250 both include a plurality of orifices for admitting and discharging air to effectuate pneumatic operation of the ram 154 and piston 152. Barrel cylinder 150 (FIGS. 12, 13) includes a plurality of orifices 256 through 258 and 259A. Mount 250 is provided with a plurality of pneumatic inlet orifices 274–279 and 279B (FIG. 14), as well as a vent 270.

Figure 15:
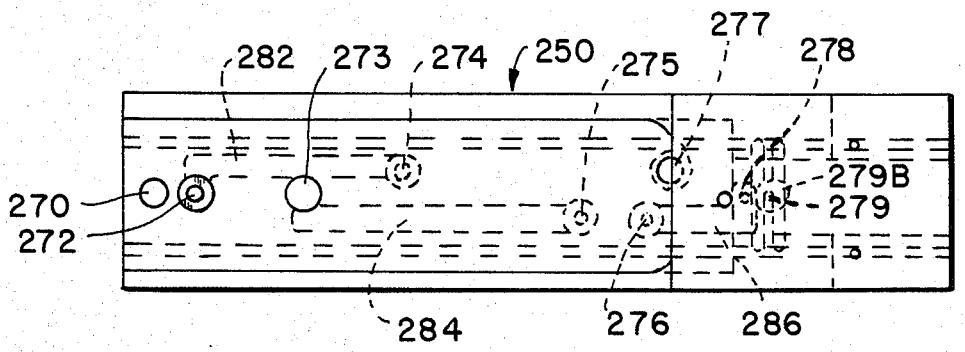
FIG. 15 is a top plan view of the cylinder mount taken generally along line 15—15 of FIG. 12.

Mounting 250 includes pneumatic output orifices 272 and 273 (FIG. 15). Passageway 279 (FIG. 12) vents the region between O-rings 159 as will later be described. Orifices 272 and 274 are interconnected though a passageway 282. Orifices 273 and 275 are interconnected by an internal passageway 284. Orifices 276 and 278 (FIG. 15) are interconnected by internal passageway 286.

Manifold 164 (FIGS. 16, 16A) is preferably sandwiched between trigger valve housing 160 and intermediate air section 140. Manifold orifice 180 (aligned with trigger housing orifice 166) transmits air through passageway 178 out through orifice 184, which is aligned with intermediate section orifice 202 in assembly. Thus when trigger 52 is pulled to rearwardly deflect trigger spindle valve 127, passageway 178 transmits air into the rear of the second intermediate pneumatic chamber 145 (FIGS. 17, 18).

Manifold orifice 172 is coupled to orifice 162 in the trigger valve housing and leads to internal passageway 170, which extends to passageways 211 (coupled to intermediate section 207), passageway 174, and orifice 175.

Thus air normally outputted through the trigger valve housing when the trigger and trigger valve are at rest (i.e. when the trigger is not pulled; FIG. 16) pressurizes line 170 and orifice 211, pressurizing intermediate valve chambers 143, 145 through orifices 216, 207 respectively. Air is additionally normally supplied via lines 173A, 173B (defined in the intermediate air control section 40) to quick dump chamber 277 as will later be explained (FIG. 12).

Manifold orifice 188 is sealingly mated to orifice 204 within the intermediate air section. A hose 205 (FIGS. 2, 16) penetrates orifice 188 and is routed around the trigger assembly, being permanently pressurized by attachment to air supply line 132 in handle 50.

Manifold orifice 210 aligns with intermediate section orifice 206 to vent second intermediate air control chamber 145, depending upon the position of spool valve 144. Manifold orifice 211 is coupled to intermediate orifice 207 to normally pressurize chamber 145 (depending upon the position of spool valve 144) in response to pressure supplied to line 170. Orifice 212 vents orifice 208. Orifice 175 pressurizes quick dump lines 173A, 173B (FIG. 16), being sealing coupled with a conventional O-ring to intermediate section inlet 216. Orifice 175 in manifold 164 thus pressurizes first intermediate chamber 143 via aligned orifice 216. Depending upon the position of first intermediate spool valve 142, air may thus be routed from orifice 175 out of intermediate pneumatic section orifice 221 or 222. Orifice 217 and passageway 219B vent chamber 143 depending upon the position of spool valve 142.

In assembly it must be appreciated that conventional O-rings are employed to matingly seal connecting orifices of adjacent parts. Thus a plurality of O-rings will insure fluid flow integrity between the manifold (FIG. 16A) nested against the underside of the intermediate air control section (FIG. 18). Similarly the top of the intermediate section 140 (FIG. 17) will be sealed against the underside of the mount 50 (FIG. 14). The underside of the barrel cylinder 150 (FIG. 13) will similarly be sealed with alignment of appropriate apertures to the top of the cylinder mount (FIG. 15).

The intermediate air control section 40 thus includes a plurality of upper output and vent orifices (FIG. 17) which align with similar apertures in the bottom of the cylinder mount (FIG. 14). The quick dump cylinder 277 (FIG. 16) houses a piston 224 for evacuating the front of the barrel cylinder when the gun fires. Normally piston 223 is biased toward sealing O-ring 226A, which is disposed within the top of cylinder section 277 (FIGS. 12, 16).

Intermediate section output orifice 220 (FIGS. 16–18) distributes high pressure air entering chamber 145 to barrel mount orifice 274 (FIG. 12) in response to movement of second intermediate spool valve 144. Air thus routed into rest areas of the firing chamber first energizes the internal piston 152 FIGS. 7, 10). As seen in FIGS. 12,14, and 15, air flows through orifice 274, passageway 282 and out orifice 272, which is coupled to barrel cylinder inlet orifice 258 (FIG. 13) to pressurize the firing cavity (i.e. to the rear of piston 152).

Intermediate section output orifice 221 (FIGS. 16, 18) is coupled to an orifice 275 (FIGS. 12, 14, 15) communicating with output orifice 273 via internal passageway 284. Outlet 273 couples to barrel cylinder inlet 257 (FIG. 13) to pressurize the chamber interior just ahead of piston 152 and behind ram 154. The latter effect is controlled by movement of the first intermediate spool valve 142.

Figure 13:
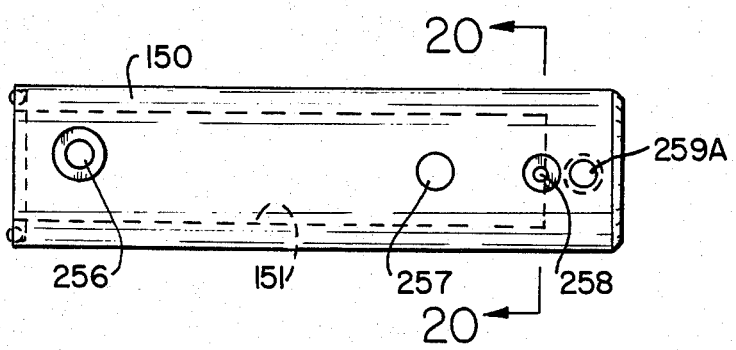
FIG. 13 is a bottom plan view of the ram cylinder.

Intermediate section output orifice 222 (FIGS. 16–18) outputs air to orifice 276 (FIGS. 14, 12) at the bottom of the mount 250; air is thus transmitted through passage 286 (FIG. 14) into output orifice 278 through chamber 277, which mates with barrel input orifice 256 (FIG. 13). Cylinder 277 is also vented to exhaust passageway 278B via passageway 286X (FIG. 12).

With particular attention now directed to FIGS. 7–12, the pneumatic barrel assembly 60 comprises a pneumatic mount 250 (FIG. 12) secured at the top of the gun, which mount receives generally tubular barrel cylinder 150. Cylinder 150 includes an internal chamber 151 in which piston 152 and elongated ram 154 are coaxially disposed. Both ram 154 and piston 152 are axially displaceable within the barrel chamber 151 and their cooperative pneumatic operation results in the ultimate ejection of a rivet. Essentially piston 152 reacts to pneumatic pressure inputted through port 258 (FIGS. 7, 12) to forcibly ram the plunger 157 within the ram 154 toward the left (as best viewed in FIG. 7). As will hereinafter be described, ram 154 receives and separates a rivet to be installed from the gripper arm assembly (FIGS. 5, 21) when it is "loaded". Subsequently the plunger forces the rivet out of the feed head passageway 64B into a suitable workpiece aperture, in response to piston contact. Piston force is sufficient to drive rivet stem 41 through its flange 47 to expand the forwardly projecting legs 44 and thereby permanently install the rivet.

Figure 8:
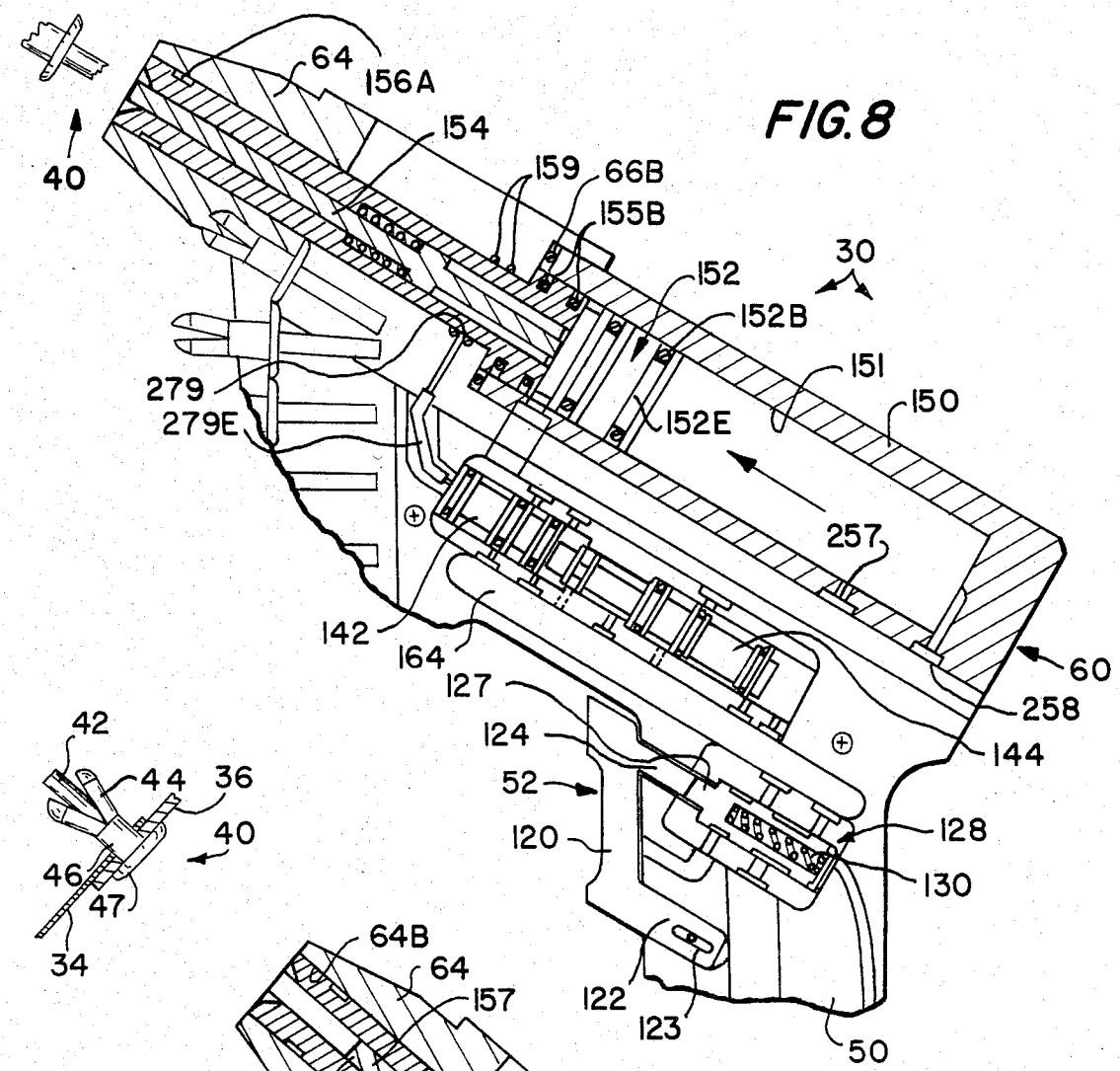
FIG. 8 is a fragmentary, sectional view of the gun with portions omitted for clarity; illustrating the ram and piston in a fired position.

Piston 152 is preferably machined from brass, and includes a pair of conventional O-rings 152B disposed on opposite sides of its larger diameter center 152E (FIG. 8). Piston 152 is axially slidably disposed within the chamber 151, and it may move from the rest position illustrated in FIGS. 7 and 10, for example, to the plunger contacting "fired" position illustrated in FIG. 8. The ram 154 includes an elongated, preferably plastic shank 156 terminating in a rear, piston-contacting spool valve section 155 (FIG. 7) equipped with a pair of conventional O-rings 155-B. A rivet contacting end 154E (FIG. 7) forcibly contacts the flange portion 47 of a rivet to be ejected and installed. Importantly, a venting groove 156A is defined within end 154E for purposes which will hereinafter be described. The ram assembly 154 also includes an inner, preferably metallic, elongated plunger generally designated by the reference numeral 157, which has a front 157B and a rear 157A. This plunger is coaxially, slidably secured interiorly of the ram 54. Plunger 157 is yieldably biased towards the rear of the ram 154 by an internal spring 158 which abuts a shoulder portion 57E. Thus it will be apparent that, when activated, piston 152 will slide into forceable contact with end 157A of the plunger 157, driving it forwardly into the plunger assembly 154. The ram assembly will thus move left (as viewed in FIG. 7); the plunger end 154E thereof forcibly contacting a rivet stem 42 slidably received and captured within plunger assembly passageway 54K. The ram 157 will thus forcibly separate rivet stem 42 from the flange 47 driving the rivet stem through the core of the rivet to expand the legs 44 previously discussed. As will hereinafter be described in detail, means are provided for returning the piston 152 to a rest position, and for recycling the ram rearwardly and then forwardly in response to the functioning of the intermediate valves previously discussed. Rearward axial withdrawal of plunger 157 from ram 154 is prevented by retainer 157J (FIG. 7).

Groove 156A defined in end 154E of the ram 154 facilitates important recycling and venting effects when it passes rearwardly between stationary O-rings 159 (FIGS. 7,12) during recycling. When disposed between these O-rings, air will be vented down passageway 279 through orifice 279B (FIG. 12) and through a tubular connection 279E (FIG. 7) which terminates at the left (as viewed in FIG. 16) end of the intermediate air control section 140. Specifically, a return blast of air is delivered into first intermediate valve chamber 143 to forcibly return first intermediate spool valve 142 rearwardly. Thus pneumatic power delivered to the piston and ram assemblies is employed to return the intermediate spool valves to a recycled position.

During rapid forward travel of the fired piston, air within the barrel chamber 151 must be vented. To this effect a quick dump assembly comprising piston 224 (FIGS. 16, 12) is provided to vent the forward area of chamber 151 during firing. Piston 224 is normally seated against O-ring 226 (FIG. 12), but it is deflected downwardly in the quick dump valve chamber 277 to allow dump venting through transverse port 203B (FIGS. 5, 12). A push back region or passageway 278 (FIG. 12) inputs air into chamber 151 at its forward extreme. As will hereinafter be described in detail, pneumatic pressure switched into this pushback region 278 immediately behind an O-ring 281B (FIG. 12) will forcibly return the plunger assembly partially towards the rear of chamber 151 to initiate recycling. Simultaneously dump valve 224 is closed by air entering cylinder 277 via passages 173B, 173A (FIG. 16).

OPERATION

Figure 2:
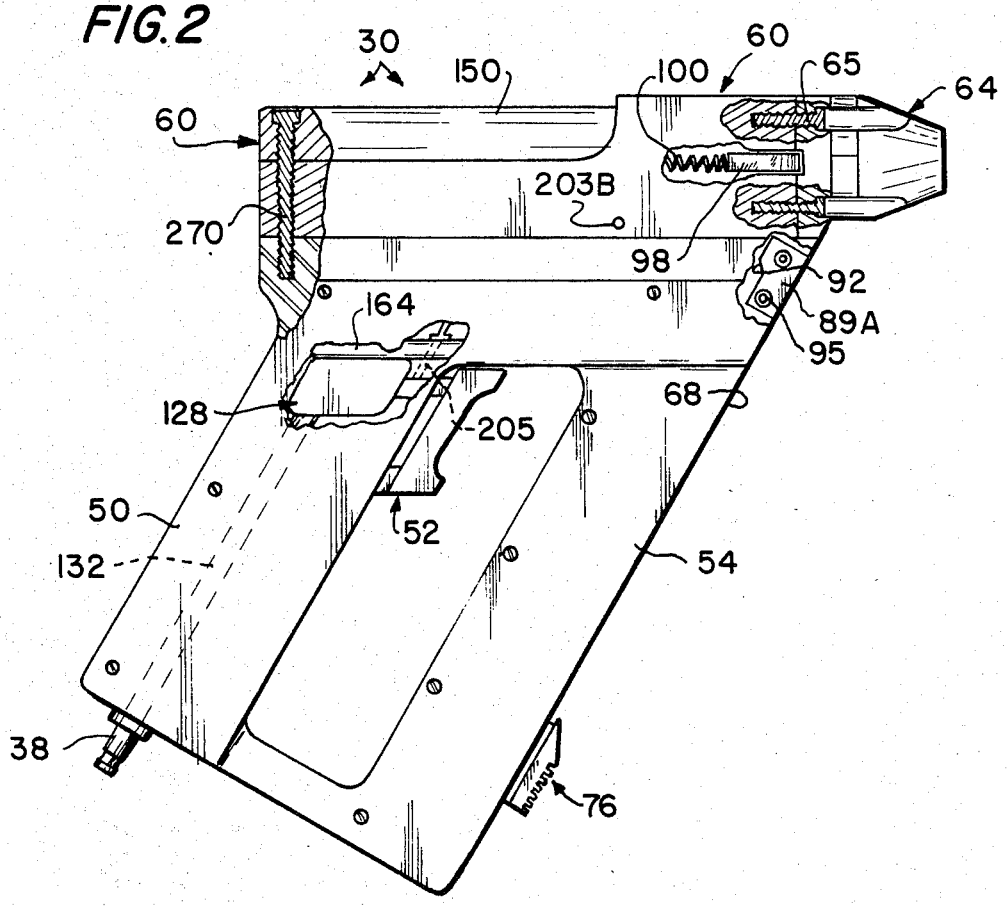
FIG. 2 is a side elevational view of the rivet gun, with portions thereof broken away, omitted, or shown in section for clarity.

Operation of the gun 20 is essentially effectuated by grasping the gun with the hand 32 of the user about handle 50 as in FIG. 1. As the trigger 52 is pulled by finger 31, rivets will be serially ejected from head 64 into appropriate orifices, such as those within metal sheets 34 or 36. Loading of the device is facilitated by moving the rivet loader 76 (FIG. 6) all the way to the bottom of the magazine (to the right as viewed in FIG. 6) exposing a larger width slot 73B at the bottom of slot 72. Slot 73B will thus clear the flanges 47 of rivets to be installed. While rivets may preferably be inserted in the form of strips, wherein the adjacent flanges of a serial line of rivets are molded together, rivets may of course be loaded individually through the slot 73B. To implement operation of the loaded gun, high pressure air through a quick connect disconnect terminal must be snapped onto input fitting 38.

Movement of internal parts during pneumatic cycling is best understood with reference to FIGS. 7–12, 16 and 19–21. The relationship and establishment of critical air paths will additionally be clarified through a study of FIGS. 13–15 and 16A through FIG. 18.

In the quiescent state (FIG. 16) the gun (and the manifold) should be assumed to be loaded, and properly coupled to an available high pressure air hose coupled to fitting 38. High pressure air will be transmitted to passageway 132 and it will enter the trigger pneumatic control section 128 through the orifice 134 defined in the trigger valve housing 160. Air will thus be routed around trigger spool valve 127 into orifice 162 in housing 160 from which it will enter manifold 164 within passageway 170 thereby pressurizing orifices 207 and 216. Additionally passageway 173A–173B will be pressured to maintain quick dump valve piston 224 in sealing engagement against O-ring 226A. Air enters second intermediate chamber 145 through orifice 207 to urge second intermediate pneumatic control spool valve 144 to the rear (i.e. to the right as in FIG. 16) to make it assume a rest position. Air passing through orifice 216 enters the first intermediate air control chamber 143, and is routed around first intermediate spool valve 142 existing through output orifice 221, which is coupled to orifice 275 (FIG. 12) passageway 284, 273 and barrel inlet orifice 257 (FIGS. 13, 12). Air thus entering the barrel chamber 151 through orifice 257 (FIG. 7) will maintain piston 152 toward the rear (i.e. to the right in FIG. 7) of the chamber 151, and will maintain ram 154 forward.

Also during this quiescent or rest state high pressure air from handle passageway 132 is transmitted through hose 205 into orifice 204 which communicates interiorly of second chamber 145 to pressurize the region between O-rings 144E independent of the position of trigger valve 127.

The "fire" state is initiated by a manually pulling trigger 52 to deflect trigger spool valve 127 rearwardly (i.e. to the right as viewed in FIG. 16) in response to movement of trigger link 124. When the trigger spool valve 127 is thus moved, high pressure air is routed through orifice 166 defined in the trigger housing 160, entering manifold passage 178 and exiting manifold orifice 184, being delivered to input orifice 202 and entering the second intermediate pneumatic chamber 145 immediately to the rear of second intermediate spool valve 144. This forces second intermediate valve 144 to the left, contacting first intermediate valve 142 and similarly moving it towards the left (as viewed in FIG. 16). Forward movement of intermediate valves 142, 144 results in the establishment of a variety of air paths.

Air formerly constrained between O-rings 144E will exit through orifice 220 to be transferred in to the rear area of the barrel chamber 151 to force piston 152 toward the left (i.e. as viewed in FIG. 7). This "firing pressure" is thus delivered to the rear of the barrel chamber without passage through the trigger housing 160 to provide a relatively large volume of air. Air enters orifice 274 (FIG. 12) in the pneumatic plunger assembly mount and is transmitted through passageway 282 via orifice 272 into barrel orifice 258 (FIG. 13). Thus piston 152 is forcibly rammed forward from pressure appearing at 258B (FIG. 7). Quick dump piston 224 is deflected in this interval to depressurize cavity 151.

However, at this time the ram assembly 154 occupies the position illustrated in FIG. 8. It is to be assumed for purposes of this discussion that prior to operative contact by piston 152 ram 154 will have previously "loaded" itself with a rivet properly captured within front end 154E. When piston 152 thereafter forcibly moves down barrel 151, it will contact plunger 157 by hitting end 157A thereof to deflect it against predetermined yieldable tension from spring 158 into ramming engagement with the rivet 41. Specifically, core end 157B will forcibly ram the rivet shank 42 driving the rivet out of mouth 64B into suitable apertures. Once rivet flange 47 surrounds the periphery of the desired aperture, and hence prevents further axial displacement of the rivet body, its stem 42 will be broken away from the flange 47 and driven forcibly axially therethrough. Virtually instantaneously, the ram 154 will retract in a subsequent reloading cycle as will hereinafter be described. The position of the gripper arms 98, 99 as in FIG. 5, occurs during the retraction cycle of the ram assembly; the gripper arms occupy a position illustrated in FIG. 21 when the ram assembly 154 is disposed as in FIG. 8. Immediately after the ram assembly 154 begins recycling, it moves rearwardly to a position illustrated in FIG. 10; at this instant the gripper arms engage the next rivet to be ejected, occupying the configuration as indicated in FIGS. 19 and 5.

Figure 9:
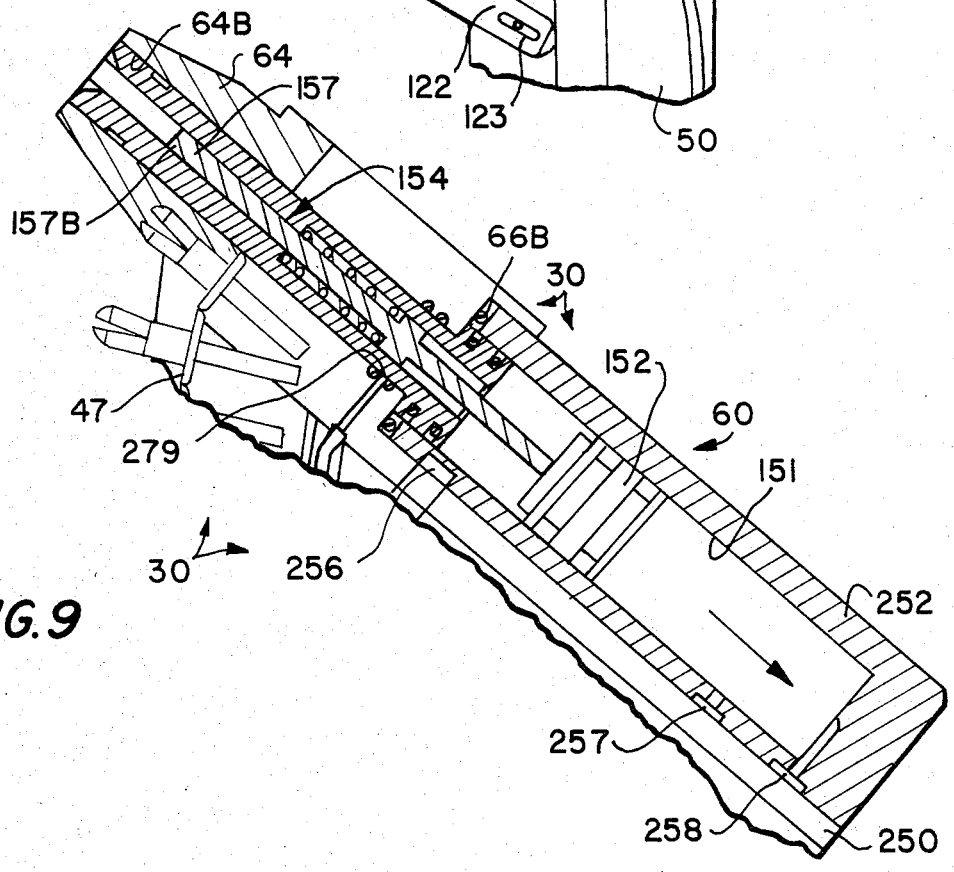
FIG. 9 is a fragmentary, sectional view similar to FIG. 8, but illustrating the ram and its plunger in a post rivet ejection position; and with portions such as O-rings omitted for clarity.
Figure 10:
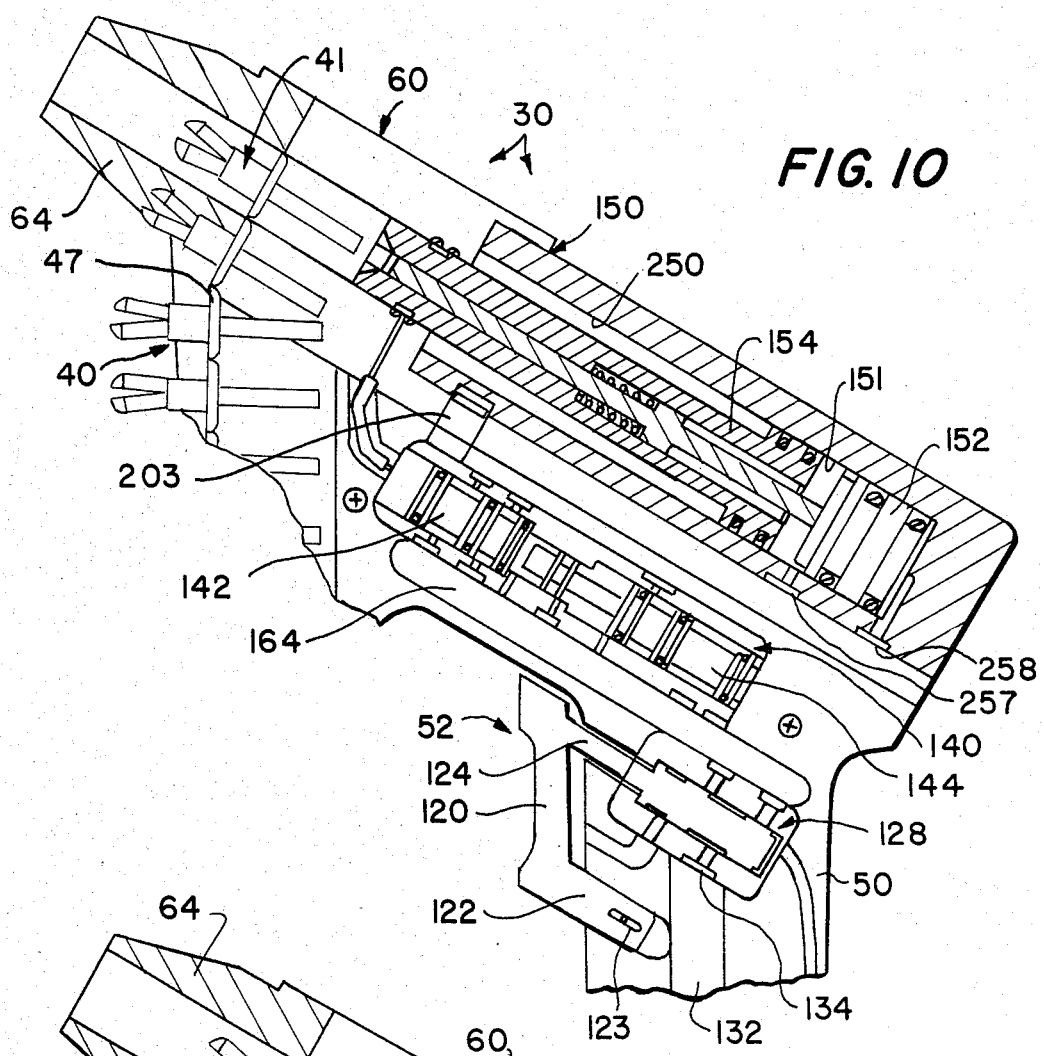
FIG. 10 is a fragmentary sectional view similar to FIGS. 8 and 9, but illustrating the piston in a rest position and the ram in an intermediate recycling position; and with portions such as O-rings omitted for clarity.
Figure 11:
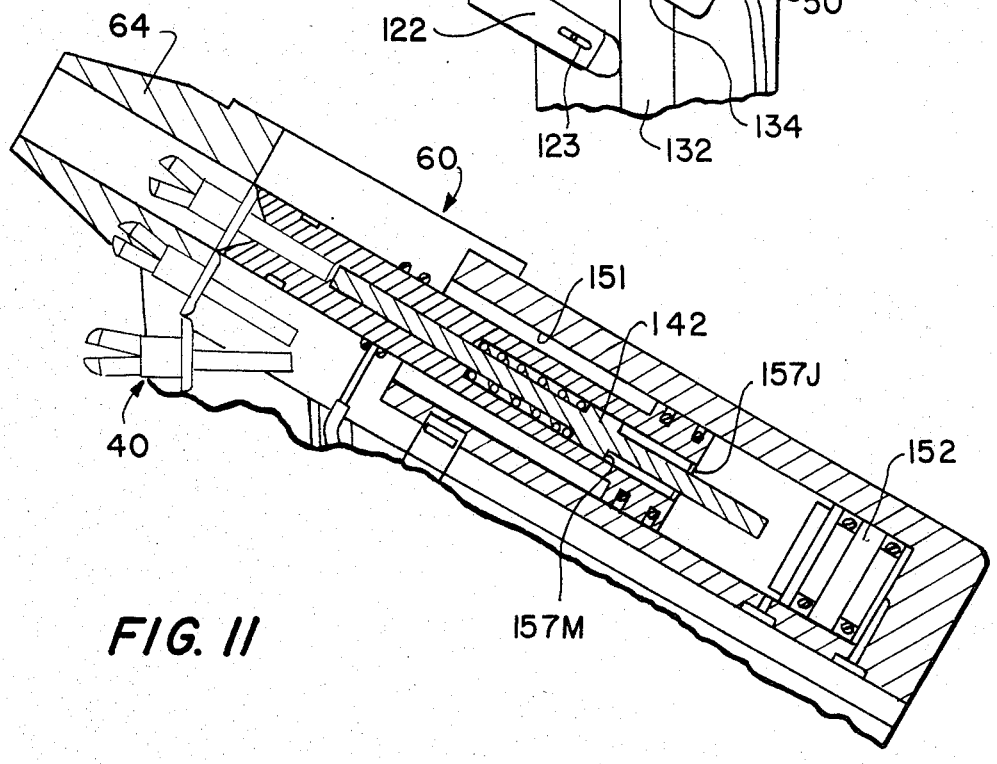
FIG. 11 is a fragmentary sectional view similar to FIGS. 8–10 illustrating the ram in an intermediate loaded position, with portions omitted for clarity.

A third major operative state occurs after a rivet is installed, or when the trigger is released by the operator to facilitate a subsequent installation. FIG. 9 illustrates an instantaneous position wherein ram assembly 154 (and plunger 157) has moved as far left as possible to effectuate the installation of a rivet. When the trigger is released, air paths are established to forcibly recycle piston 152 and ram 154. Piston 152 is recycled simply by moving all the way to the right (as viewed in FIGS. 8 and 9). However ram assembly 154 is recycled by first moving the assembly backwards through the position illustrated in FIG. 7 to the position in FIG. 10, and thereafter returning it all the way to the left to deflect the gripper arms and load a rivet for subsequent ejection, as primarily indicated in FIG. 11. Thus by repeatedly cocking the ram assembly, the semi-automatic operation of the gun is pneumatically facilitated.

Soon after release of the trigger, spring 130 will return trigger spool valve 127 toward the left (as viewed in FIG. 16). High pressure air will thence be transmitted through manifold line 170 to the intermediate spool valves 142 and/or 144. Initially the second intermediate spool valve 144 is forced to the rear in response to pressure from orifice 207 bearing against spool 144 adjacent O-rings 202E. The first intermediate spool valve 142 in effect transfers air from incoming orifice 216 through outlet 222 in communication with orifice 276 (FIGS. 14, 15) through passageway 286 and out orifice 278 and upwardly within the pneumatic plunger assembly mount 250 through passageway 278B (FIG. 12).

Air transmitted through line 278B and line 278E is inputted at the front of barrel 150 through orifice 356 (FIG. 13) forcibly returning the ram and the piston to the rear of the barrel, in which position the piston remains but the ram does not.

As the plunger 154 moves rearwardly, plunger groove 156A (FIG. 10) will temporarily align itself between fixed O-rings 159. At this time air will be vented through passageway 279 and hose 279E into the front (the left in FIG. 16) of the first intermediate spool valve chamber 143. This thus repressurizes the first intermediate spool valve 142 returning it to the right (as viewed in FIG. 16). Ram assembly 154 cannot move any further rearwardly than a position in which its groove 156A is positioned between O-rings 159, since its rear 155 will abut piston 152, the plunger 157 being deflected therewithin.

Since the first intermediate spool valve 142 has been returned to its rest position (illustrated in FIG. 16) by venting between O-rings 159 through passage 279, 279E, high pressure air will now again be transmitted out of orifice 221 into orifice 275 (FIG. 14) through passageway 284, through outlet 273 and into barrel port 257 just ahead of piston 152 but behind the ram assembly (FIG. 7). Also, when first spool intermediate valve 142 is moved to the right, intermediate orifice 222 is vented via lines 219A, 219B; this depressurizes the front portion of the barrel chamber 151 via line 279B (FIG. 12) previously discussed allowing the plunger to subsequently move forward.

The final stage essentially involves return forward movement of the ram to reload a rivet. Rivets biased upwardly within the magazine are forced into the gripper arm area, and while the plunger assembly 154 moves rearwardly during recocking, the gripper arms will firmly maintain the next rivet in place for reloading, as illustrated in FIG. 5. The plunger assembly 154 returns forward since high pressure air is inputted into the barrel chamber behind it through orifice 257. As it moves into contact with the gripper arms its forward edge 154E deflects them apart, and the rivet stem is captured within passageway 154K (FIG. 7). This trips the rivet out of the gripper arms since the ends 101 of the gripper arms are wedged apart into the position of FIG. 21. A rivet is now loaded and the cycle may repeat.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A pneumatic, semi-automatic, hand-held rivet applicator gun comprising:

rigid pistol grip means adapted to be gripped by a user for operating the gun;

magazine means for storing a plurality of rivets and for serially feeding them for subsequent application by said gun;

barrel means for serially receiving rivets from said magazine means, said barrel means having an internal chamber defined therein, said chamber including ram means and piston means axially displaceable therewithin for periodically forcibly dispensing rivets from said barrel means;

said ram means including internal, substantially coaxially aligned plunger means adapted to be forcibly contacted by said piston means for installing a rivet;

intermediate pneumatic means for actuating said barrel means; and, trigger actuated pneumatic control means adapted to be coupled to an external pneumatic source for actuating said intermediate pneumatic control means in response to manual operation of a trigger associated with said grip means;

said trigger actuated pneumatic control means including a trigger valve chamber having a plurality of ports and a trigger valve disposed for axial movement therewithin;

said intermediate pneumatic means including an intermediate chamber, first and second axially aligned intermediate valves confined within said chamber for axial movement in response to pneumatic signals derived from said trigger actuated pneumatic control means, and a plurality of pneumatic input and output ports;

said pneumatic barrel chamber including a plurality of inlet ports in fluid flow communication with said intermediate pneumatic switch output ports;

said trigger valve being configured to establish, when in a rest position relative to said trigger valve chamber ports, a pneumatic path flowing to said intermediate chamber to bias said first said second intermediate valves to a rest position; and, said second intermediate valve, when in a rest position, being configured to establish a pneumatic path through preselected output ports in said intermediate chamber in fluid flow communication with preselected ones of said barrel chamber inlet ports to effectuate biasing of the piston means to a rest position and biasing of said ram means to a loaded rest and ready position.

2. The rivet gun as defined in claim 1 wherein:

said trigger valve is configured to establish relative to said trigger valve chamber ports, and when deflected to a fired position by said trigger, pneumatic paths sufficient to fire both of said intermediate valves, and, said trigger valve when released returns said second intermediate valve to a rest position; and, said second intermediate valve being configured to establish, relative to said intermediate chamber and when moved to a fired position in response to said trigger valve, a pneumatic path pressurizing the barrel chamber at the rear of the piston means causing it to forcibly activate said plunger means.

3. The rivet gun as defined in claim 2 wherein:

said first intermediate valve is configured to establish, relative to the intermediate chamber, and when in a "fired" position; sufficient pneumatic paths to return the ram means and piston means rearwardly after firing; and, the ram means is configured to establish, after installation of a rivet, and rear movement of a preselected amount responsive to said first intermediate valve, an air path returning said first intermediate valve to a fire position, the assumption of said first intermediate valve to a fire position recycling said ram means to a rest and ready position.

4. The rivet gun as defined in claim 3 wherein:

said ram means includes forward groove means;

said barrel includes a pair of stationary O-rings mounted about an air pathway coupled in fluid flow communication to the intermediate pneumatic means; and, said first intermediate valve and the alignment of said groove means between said O-rings establishing said air path which returns said first intermediate valve to said rest and ready position.

5. The rivet gun as defined in claim 4 including:

quick-dump means for depressing said barrel chamber when said piston is fired; and, vent means for depressurizing said barrel chamber when said ram means is recycling rearwardly.

6. The rivet gun as defined in claim 5 including:

gripper arm means for receiving rivets from said magazine means and temporarily holding them while said ram means recycles rearwardly; and, said gripper arm means operative to release said rivet in response to contact by said ram means.

7. A method of serially installing plastic expansion rivets comprising the steps of:

providing a gun-like frame adapted to be held by the hand of an operator with a magazine for storing rivets to be applied and for automatically feeding them to a feed position;

pneumatically controlling and initiating operation of said gun with a trigger-operated pneumatic trigger control valve operatively coupled to a source of high pressure air;

loading said rivets within an axially displaceable ram disposed within a generally tubular barrel;

forcibly discharging said rivets from said ram and said gun by forcibly contacting a plunger coaxially, slidably disposed within the ram by a piston axially slidable within the barrel independent of said ram;

controlling pneumatic operation of said ram and said piston with an intermediate pneumatic control valve system operated by said trigger operated pneumatic control valve by generating a plurality of pneumatic control signals with first and second independent intermediate spool valves disposed within adjacent intermediate pneumatic chambers, said controlling step including the steps of:

first said piston in response to actuation of said trigger valve by simultaneously moving both said first and second intermediate valves to a fire position in response to said trigger valve whereby to activate said piston; and, returning said piston to a rest state and recycling and thus recocking said ram in response to release of said trigger valve.

8. The method as defined in claim 7 including the steps of:

returning said second intermediate valve to a rest position in response to release of said trigger;

in response to movement of said second intermediate valve to a rest position, concurrently moving said piston to a fire state and returning said ram rearwardly to a recycle position;

returning said first intermediate spool valve to a rest position in response to movement of said ram to said recycle position; and, recycling said ram to a fire position in response to return movement of said first intermediate valve to said rest position.

9. The method as defined in claim 7 including the steps of:

temporarily restraining the next rivet to be outputted between a pair of gripper arms prior to said recycling of said ram to a fire position; and, releasing said gripper arms simultaneously with the capture of said last mentioned rivet in response to physical contact of the gripper arms by said ram as it is recycled toward a loaded fire position.

10. The method as defined in claim 9 including the step of venting said gun barrel with a quick dump vent valve during firing of said piston.

11. The method as defined in claim 10 including the step of venting said barrel during recycling of said ram with a pneumatic pathway exposed by said first intermediate valve.

* * * * *